US009719444B2

(12) United States Patent
Lippitt

(10) Patent No.: US 9,719,444 B2
(45) Date of Patent: Aug. 1, 2017

(54) ENGINE WITH CENTRAL GEAR TRAIN

(71) Applicant: Raymond F. Lippitt, Smithfield, NC (US)

(72) Inventor: Raymond F. Lippitt, Smithfield, NC (US)

(73) Assignee: Raymond F. Lippitt, Smithfield, NC (US)

( * ) Notice: Subject to any disclaimer, the term of this patent is extended or adjusted under 35 U.S.C. 154(b) by 0 days.

(21) Appl. No.: 15/034,675

(22) PCT Filed: Oct. 30, 2014

(86) PCT No.: PCT/US2014/063110
§ 371 (c)(1),
(2) Date: May 5, 2016

(87) PCT Pub. No.: WO2015/069536
PCT Pub. Date: May 14, 2015

(65) Prior Publication Data

US 2016/0273470 A1 Sep. 22, 2016

Related U.S. Application Data

(60) Provisional application No. 61/900,258, filed on Nov. 5, 2013.

(51) Int. Cl.
*F01B 1/10* (2006.01)
*F02D 41/10* (2006.01)
(Continued)

(52) U.S. Cl.
CPC ..... *F02D 41/10* (2013.01); *F01B 1/08* (2013.01); *F01B 1/10* (2013.01); *F02B 75/282* (2013.01); *F02D 41/26* (2013.01); *F02M 39/00* (2013.01)

(58) Field of Classification Search
CPC ..... F02D 41/10; F02D 41/26; F02D 41/30; F02D 41/12; F02D 41/0087; F02B 75/021;
(Continued)

(56) References Cited

U.S. PATENT DOCUMENTS 1,681,910 A 8/1928 Slaght
2,199,625 A 5/1940 Fiala-Fernbrugg
(Continued)

FOREIGN PATENT DOCUMENTS

GB 301677 12/1928

OTHER PUBLICATIONS

International Search Report for PCT/US2014/063110 filed Oct. 14, 2014.
(Continued)

*Primary Examiner* — Jacob Amick
(74) *Attorney, Agent, or Firm* — Pillsbury Winthrop Shaw Pittman LLP

(57) ABSTRACT

An engine including having a frame structure with a central longitudinal space containing a gear train in which end gears drive end crankshafts and a central gear drives a central crankshaft, a pair of dual piston and cylinder assembly are connected between each end crankshaft and central crankshaft on opposite side of the central space. The combustion chambers of cylinders on each side of the central are intercommunicated by passages extending through the hubs of gears in the gear train, a controller for the fuel injectors of the cylinders selectively causes the double pistons of each pair of passage connected to have either simultaneous internally fired power drive strokes in one mode or simultaneous internally fired and shared power drive strokes in another mode.

8 Claims, 3 Drawing Sheets

(51) Int. Cl.

| | |
|---|---|
| ***F01B 1/08*** | (2006.01) |
| ***F02B 75/28*** | (2006.01) |
| ***F02D 41/26*** | (2006.01) |
| *F02M 39/00* | (2006.01) |

(58) Field of Classification Search
CPC ..... F02B 75/225; F02B 75/282; F01B 1/10; F01B 1/08
See application file for complete search history.

(56) References Cited

U.S. PATENT DOCUMENTS

| | | | | |
|---|---|---|---|---|
| 2,269,948 | A | 1/1942 | Mallory | |
| 3,472,212 | A | 10/1969 | Chamberlain | |
| 3,623,463 | A | 11/1971 | Vries | |
| 3,880,126 | A | 4/1975 | Thurston et al. | |
| 4,170,970 | A | 10/1979 | McCandless | |
| 4,172,434 | A | 10/1979 | Coles | |
| 4,250,850 | A | 2/1981 | Ruyer | |
| 4,955,328 | A | 9/1990 | Sobotowski | |
| 5,022,353 | A | 6/1991 | Kamamura | |
| 5,727,513 | A | 3/1998 | Fischer | |
| 5,758,610 | A * | 6/1998 | Park | F02B 33/26 123/51 A |
| 6,209,495 | B1 | 4/2001 | Warren | |
| 6,338,328 | B1 | 1/2002 | Mower et al. | |
| 6,363,907 | B1 | 4/2002 | Arai et al. | |
| 6,978,204 | B2 | 12/2005 | Surnilla et al. | |
| 6,988,471 | B2 | 1/2006 | Chang | |
| 6,994,057 | B2 | 2/2006 | Loth et al. | |
| 7,080,615 | B2 | 7/2006 | Shinogle | |
| 7,219,634 | B2 | 5/2007 | Hitomi et al. | |
| 7,383,797 | B2 | 6/2008 | Tour | |
| 7,578,267 | B2 | 8/2009 | Hofbauer et al. | |
| 7,685,988 | B2 | 3/2010 | Almkvist et al. | |
| 7,823,547 | B2 | 11/2010 | Forner, Sr. et al. | |
| 7,954,472 | B1 | 6/2011 | Sturman | |
| 7,958,864 | B2 | 6/2011 | Sturman | |
| 8,006,656 | B2 | 8/2011 | Branyon et al. | |
| 8,051,811 | B2 | 11/2011 | Phillips | |
| 8,132,546 | B2 | 3/2012 | Surnilla | |
| 8,156,904 | B2 | 4/2012 | Giannini et al. | |
| 8,443,769 | B1 | 5/2013 | Lippitt | |
| 8,899,193 | B2 | 12/2014 | Lippitt et al. | |
| 9,026,339 | B1 | 5/2015 | Sturman | |
| 2005/0022755 | A1 | 2/2005 | Hitmoi et al. | |
| 2006/0102124 | A1 | 5/2006 | Calderwood | |
| 2007/0034175 | A1 | 2/2007 | Higgins | |
| 2007/0215093 | A1 | 9/2007 | Lemke et al. | |
| 2008/0029057 | A1 | 2/2008 | Hergart et al. | |
| 2008/0047530 | A1 | 2/2008 | Cleeves | |
| 2009/0020103 | A1 | 1/2009 | Van Avermaete | |
| 2009/0145396 | A1 | 6/2009 | Almkvist et al. | |
| 2009/0183699 | A1 | 7/2009 | Sturman | |
| 2010/0050978 | A1 | 3/2010 | Hofbauer | |
| 2010/0056327 | A1 | 3/2010 | Hofbauer | |
| 2010/0170466 | A1 * | 7/2010 | Warren | F01L 1/30 123/190.1 |
| 2010/0229806 | A1 | 9/2010 | Kemeny | |
| 2010/0229836 | A1 | 9/2010 | Hofbauer et al. | |
| 2010/0284824 | A1 | 11/2010 | Hippen et al. | |
| 2010/0308685 | A1 | 12/2010 | Hippen et al. | |
| 2010/0326394 | A1 | 12/2010 | Hofbauer | |
| 2011/0022289 | A1 | 1/2011 | Hofbauer | |
| 2011/0057049 | A1 | 3/2011 | Hofbauer et al. | |
| 2011/0215575 | A1 | 9/2011 | Hofbauer et al. | |
| 2011/0220080 | A1 | 9/2011 | Meldolesi et al. | |
| 2011/0241473 | A1 | 10/2011 | Hippen et al. | |
| 2011/0251773 | A1 | 10/2011 | Sahandiesfanjani et al. | |
| 2012/0031379 | A1 | 2/2012 | Zhou | |
| 2012/0073538 | A1 | 3/2012 | Hofbauer | |
| 2012/0085302 | A1 | 4/2012 | Cleeves | |
| 2012/0085305 | A1 | 4/2012 | Cleeves et al. | |
| 2015/0136069 | A1 | 5/2015 | Lippitt | |
| 2015/0136083 | A1 | 5/2015 | Lippitt | |
| 2015/0142291 | A1 | 5/2015 | Lippitt et al. | |
| 2015/0167548 | A1 | 6/2015 | Lippitt | |

OTHER PUBLICATIONS

EcoMotors International Technology, obtained from url: <http://www.ecomotors.com/technology> on May 10, 2012.

Scuderi Engine, obtained from url: <http://en.wikipedia.org/wiki/Scuderi_Engine> on Apr. 26, 2012.

Split Cycle Engine, obtained from url: <http://en.wikipedia.org/wiki/Split_cycle_engine> on Apr. 26, 2012.

International Preliminary Report on Patentability for PCT/US2014/063110 dated May 10, 2016.

* cited by examiner

ENGINE WITH CENTRAL GEAR TRAIN

CROSS-REFERENCE TO RELATED APPLICATIONS

This is the U.S. National Stage of PCT/US2014/063110, filed Oct. 30, 2014, which claims benefit to U.S. Provisional Patent Application No. 61/900,258 filed Nov. 5, 2013, the entire contents of both applications are incorporated herein by reference in their entirety.

FIELD OF THE INVENTION

This invention relates to internal combustion engines and more particularly to internal combustion engine having a fuel saving mode of operation embodying the principle of the invention of U.S. Pat. No. 8,443,769.

BACKGROUND OF THE INVENTION

The abstract of U.S. Pat. No. 8,443,769 Patent describes its invention in the following language:

This invention relates to internal combustion engines and more particularly to internal combustion engines and methods of operating the engines with a new fuel saving cycle. An engine including at least two piston and cylinder assemblies preferably adjacent to one another, that when operating with the new fuel savings cycle, establish at the end of the simultaneous compression strokes a charge of compressed air in one cylinder of one assembly and a charge of compressed air fuel mixture in the other cylinder of the other assembly. When the air fuel mixture is ignited, the high pressure conditions in the other cylinder are immediately communicated through a passage to the one cylinder to accomplish a double expansion during the simultaneous power drive strokes thus using much of the pressure energy before exhaust occurs by the pistons themselves rather than to dump it as is usually done.

BRIEF DESCRIPTION OF THE INVENTION

The present invention is based upon a unique configuration of engine components capable of embodying the invention of the aforesaid '769 patent, the entirety of which is hereby incorporated by reference. The configuration includes a longitudinally elongated central space provided in the frame structure of the engine within which a train of meshing gears are mounted. A central gear of the train drives a central crankshaft and end gears of the train drive end crankshafts. Aligned crank portions of the crankshafts on opposite sides of the space move by means of connecting rods opposed pistons within a first and second pairs of cylinders through successive cycles. The cylinders of each pair are on opposite sides of the space and have combustion chambers communicated by passages extending though hubs of gears of said train enabling the fuel saving mode of the patent to take place by computer controlled injectors for each piston and cylinder assembly.

Other objects, aspects and advantages of the present application will become apparent from the following detailed description, the accompanying drawings, and the appended claims.

DETAILED DESCRIPTION OF THE INVENTION

Figure 1:
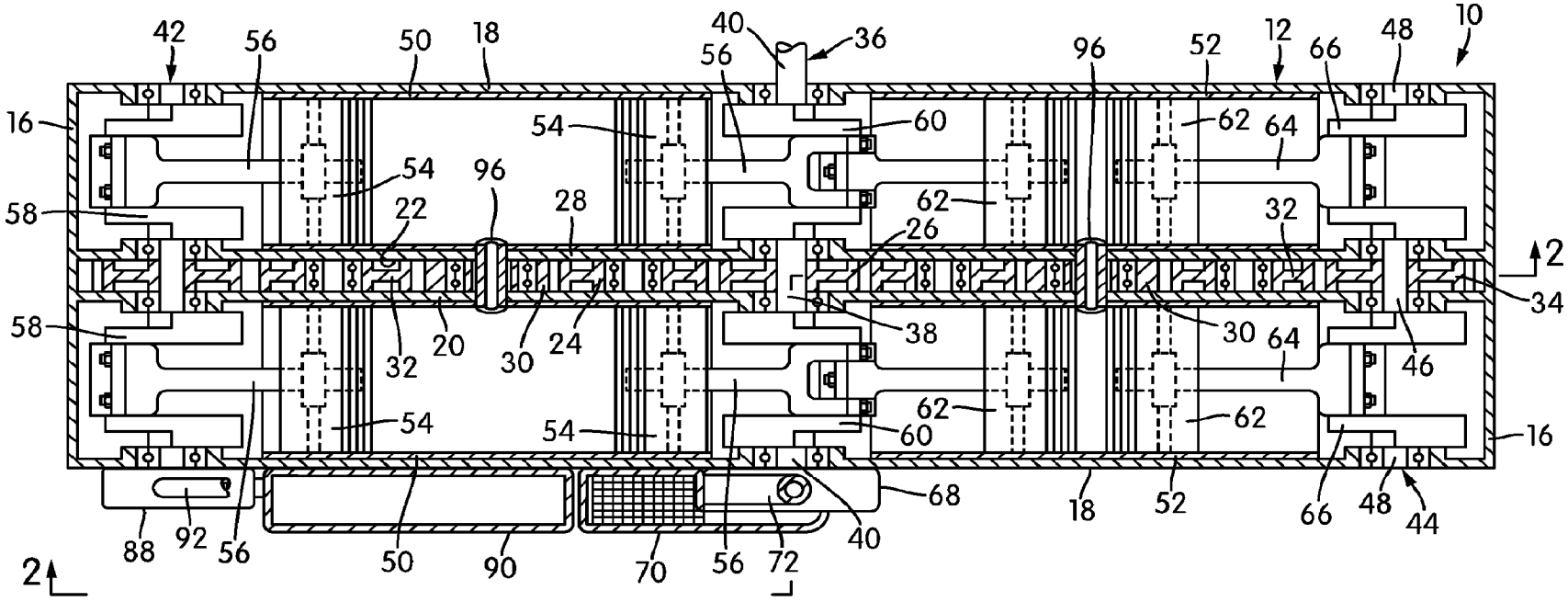
FIG. 1 is a horizontal sectional view of an engine embodying the principals of the present invention take along the common plane of the crankshafts axes of the engine.
Figure 2:
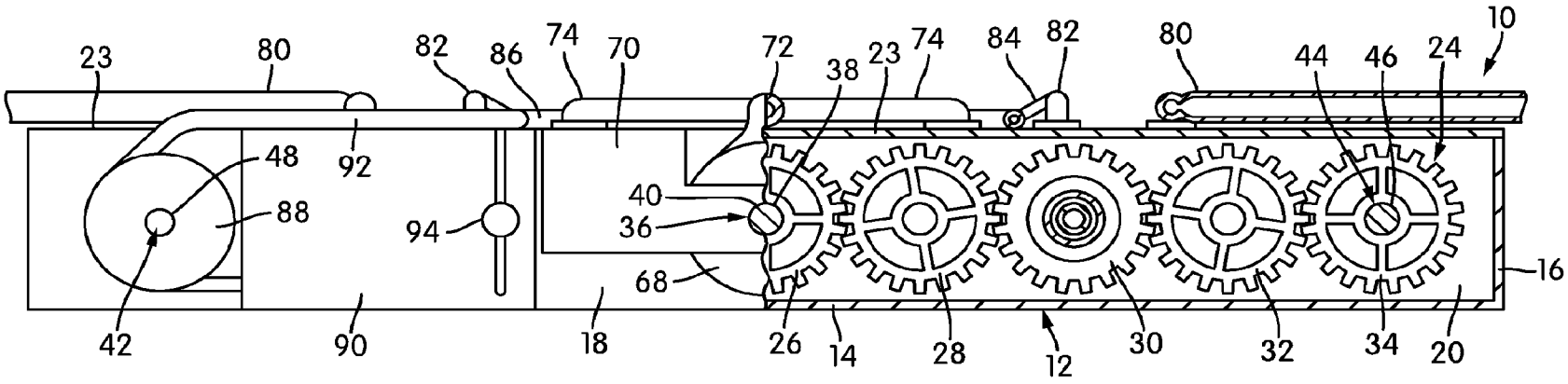
FIG. 2 is a view taken along the line 2-2 of FIG. 1.

Referring now more particularly to the drawings there is shown therein an internal combustion engine, generally indicated at 10, which embodies the principle of the present invention. The engine 10 includes a frame structure, generally indicated at 12, which includes a bottom wall 14, and end wall 16 and side walls 18 extending upwardly from the periphery of the bottom wall 14. Extending longitudinally from one end wall 16 to the other upwardly from the bottom wall 14 is a pair of transversely spaced central walls 20, which define a longitudinally extending central space 22 therebetween.

Mounted within the central space is a meshing gear train, generally indicated at 24. The gear train 24 includes a centrally located gear 26 which meshes with inner idler gears 28 on opposite sides thereof. Each inner idler gear 28 meshes with a hub containing gear unit 30, which in turn, meshes with an outer idler gear 32. Finally, each outer idler gear 32 meshes with an end gear 34.

A central crankshaft, generally indicated at 36, is connected to move with the central gear 26. To this end, the central crankshaft 36 includes a central bearing portion 38 suitably journaled in the central walls 20 and extending through the space 22 so as to be fixed coaxially with the center gear 26. The outer ends of the central crankshaft 36 include bearing portions 40 suitably journaled in the side walls 18.

In a similar manner, first and second end crankshafts, generally indicated at 42 and 44, are connected to move with the end gears 34. The first and second end crankshafts 42 and 44 include central bearing portions 46 suitably jounaled in the central walls 20 and fixed to an associated end gear and spaced end bearing portions 48 suitable journaled in the side walls 18 respectively.

Mounted on opposite sides of the central walls 20 and the space 22 therebetween is a first pair of cylinders 50 extending between the first end crankshaft 42 and the central crankshaft 36. A second pair of cylinders 52 is mounted on opposite sides of the central walls 20 and the space 22 between the second end crankshaft 44 and the central crankshaft 36.

Each first cylinder 50 has opposed first pistons 54 mounted therein for movement forward and away from another between outer and inner limiting positions though successive cycles including simultaneous compression strokes followed by simultaneous power drive strokes.

The movement of said opposed first pistons is accomplished by connecting rods 56 each having one end pivoted to one of the associated, opposed first pistons 54 and an opposite end pivoted either to a crank portion 58 of the first end crankshaft 42 or to a longitudinally aligned crank portion 60 of the central crankshaft 36.

In a similar manner, each second cylinder 44 has opposed second pistons 62 mounted therein for movement toward and away from one another between outer and inner limiting positions through successive cycles including simultaneous compression strokes followed by simultaneous power drive strokes 180° out of phase with respect to the comparable strokes of the opposed first pistons 54.

As before, the movements of the opposed second pistons 62 are accomplished by connecting rods 64 each pivoted at one end to an opposed second piston 62 and at an opposite end either to the crank portion 60 or the central crankshaft 36 or a longitudinally aligned crank portion 66 of the second crankshaft 44.

Figure 3:
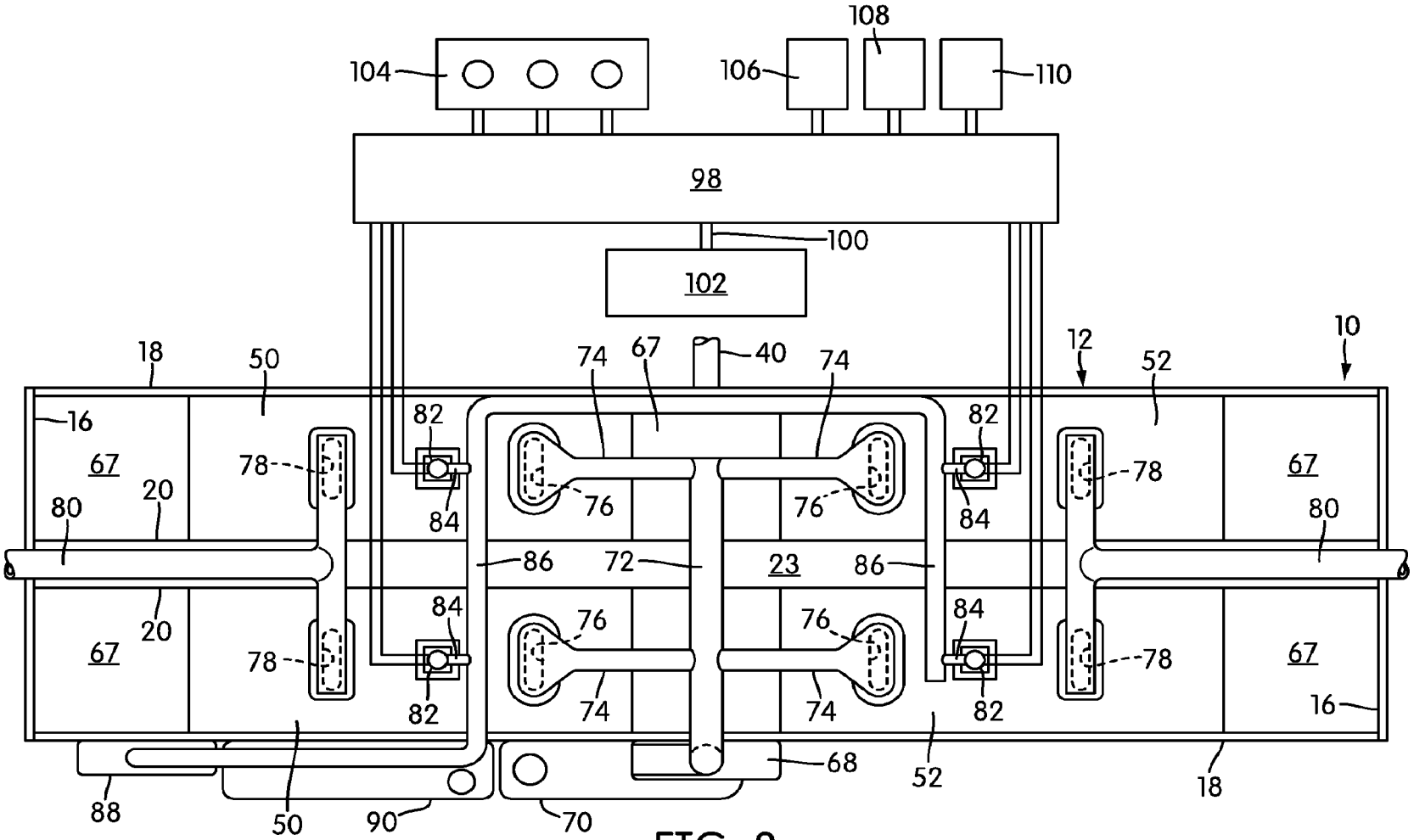
FIG. 3 is a top plan view of the engine of FIG. 1 showing a skematic of a computer control for the injectors of the engine.

Referring now more particularly to FIG. 3, one end bearing portion 48 of the central crankshaft 36 extends beyond the associated side wall 18 and has connected in driving relation thereto an air pump 68, of any well know design. An air filter unit 70 connects to the inlet of the pump 68 and the outlet thereof has a manifold duct 72 extending therefrom transversely across the associated side wall 18 toward the opposite side wall 18. Extending from the manifold duct 72 are one of the ends of four air inlet ducts 74. The opposite end of each air inlet duct 74 extends over an inlet opening 76 in a corresponding one of the four cylinders 50 and 52. Each of the four cylinders 50 and 52 also has formed therein in spaced relation to the inlet opening 76 therein and outlet opening 78. Each outlet opening 78 is suitably connect to discharge gases from the associate cylinder into suitable exhaust conduits, such as a T-shaped conduit 80 at each end.

When each of the opposed first and second pistons 54 and 62 are disposed in their outer limiting positions, the inlet and outlet opening 76 and 78 are unobstructed so that air under pressure in the associated air inlet duct 74 can flow through the associated inlet opening 76 and replace the gases in the associated cylinder outwardly thereof through the associated outlet opening 78.

As the opposed pistons move away from the outer limiting position thereof at the start of a compression stroke, opposed pistons move past both openings 76 and 78 to trap the air within the associated cylinder between the associated opposed pistons and upon further movement into the inner limiting position compress the air into a combustion chamber within the associated cylinder to an auto-ignition pressure and temperature.

As best shown in FIG. 3, the combustion chamber of each cylinder has a fuel injector 82 position to inject fuel into the aforesaid combustion chamber to cause ignition of the fuel so that the increased pressure conditions result in an internally fired power drive stroke or the opposed pistons in the associate cylinder.

Preferably, but not necessarily each injector 82 is of a known type which includes an outlet nozzle at one end communicating with a pressurized fuel inlet at its other end. A solenoid operated valve normally disposed in closing relation to the nozzle when electrically energized moves into opening relation to the nozzle to allow fuel to be injected into the associated combustion chamber.

Each injector is supplied with fuel under pressure by an inlet pipe connected to the end thereof and extending into communicating relation to a manifold pipe 86. The manifold pipe 86 is maintained with a supply of fuel under pressure by a fuel pump, such as one of any known design. As shown, the fuel pump 88 is driven by an extension of one end bearing portion 48 of the first end crankshaft 42. The intake of the fuel pump 88 is connected to a fuel tank 90 fixed to the adjacent sidewall 18.

The outlet of the fuel pump 88 is connected to one end of a v-shaped manifold pipe 92. The pressure of the fuel delivered to the manifold pipe 92 is maintain within the manifold pipe 92 by a pressure relief valve 94 suitably connected between the manifold pipe 92 and fuel tank 90.

In accordance with the principles of the aforesaid patent, the combustion chambers of each pair of cylinders 50 and 52 are intercommunicated by a passage 96. In the engine 10, each passage 96 extends across the space 22 through the hub of one of the hub containing gear units 30.

Referring again to FIG. 3, the injectors 82 are controlled by a controller preferably in the form of a computer 98. As shown, the computer 98 is powered by an electrical connection 100 to the battery 102 of the vehicle in which the engine 10 is installed.

The computer 98 is programmed (and/or contains logic circuits) to be operable near the end of the simultaneous compression strokes of the opposed first and second pistons 54 and 62 in their respective cylinders 50 and 52 to selectively control the injectors 82 for each pair of cylinders 50 and 52 to (1) undergo an injection of fuel into compressed air at an auto ignition pressure and temperature in the combustion chamber of each cylinders 50 and 52 so that the injection creates ignition of the fuel causing increased pressure conditions in the associated cylinders 50 and 52 resulting in simultaneous internally fired power drive strokes of the associated opposed pistons 54 and 62 in each pair of cylinders 50 and 52 or (2) one of the injectors 82 of each pair of cylinders 50 and 52 are controlled to undergo injection into the associate cylinders resulting in the opposed pistons therein to undergoing simultaneous internally fired power drive strokes therein and another of the injectors 82 of the each pair of cylinders 50 and 52 is controlled to undergo a skipped injection wherein no fuel is injected so that the associated cylinders 50 and 52 can share by means of the passage 96 the increased pressure conditions of the first mentioned internally fired power stroke result in the opposed pistons of the associated pair of cylinders to undertake a shared power stroke therewith.

The computer 96 is programmed (and/or contains logic circuits) to cause the injectors 82 to either undergo an injection or a skipped injection in three different modes of operation. To this end, the computer 96 is programmed to receive one of three mode selecting signals coming from a manually operated three button switch unit 104 and/or one of three vehicle mounted sensors 106, 108 and 110 and to send a selected one of three mode producing signals to selectively operate the engine 10 in one of the following three modes (1) an emergency power mode wherein the opposed first and second pistons 54 and 62 undergo simultaneous internally fired power drive strokes in their respective cylinders during each cycle (2) a normal power mode where one of the opposed first or second pistons 54 or 62 undergo simultaneous internally fired power drive strokes in their respective cylinders during each cycle while the other of the opposed first or second pistons 54 or 62 undergo simultaneous internally fired and shared power drive strokes in their respective cylinders during each cycle and (3) a coasting mode wherein the opposed first and second pistons 54 and 62 undergo simultaneous internally fired and shared power drive strokes in their respective cylinders during each cycle.

An example of the election of a mode within the computer 98 is by one of the sensors 110 being actuated when the vehicle accelerator pedal is floor boarded to signal the computer 98 to select mode (1).

Preferably the opposed first or second pistons 54 and 62 undergoing simultaneous internally fired and shared power drive strokes in modes (2) and (3) are alternated between the opposed the first or second pistons 54 and 62 during each predetermined number of cycles, as, for example a number between 1 and 10.

What is claimed:

1. An internal combustion engine comprising:

a frame structure;

a central crankshaft journaled in said frame structure for rotation about a central transverse axis;

first and second end crankshafts disposed at opposite end portions of said frame structure journaled for rotation about axes parallel to and in a common plane with respect to said central transverse axis, each of said crankshafts including a pair of transversely spaced crank portions, each pair of said crank portions having one of the ends of a pair of connecting rods mounted thereon for pivotal movement about a common axis;

a first pair of side by side cylinders mounted in said frame structure between said first end crankshaft and said central crankshaft, a second pair of side by side cylinders mounted in said frame structure between said second end crankshaft and said central crankshaft, the side by side cylinders of each pair being transversely spaced apart to define a longitudinally elongated central space therebetween, each of said crankshafts having a bearing portion extending transversely through said longitudinally elongated space and having a gear fixed thereto, the gears of said crankshafts forming components of a meshing gear train disposed within said longitudinally elongated space, causing said crankshafts to rotate together;

each of said first and second pairs of cylinders having opposed first and second pistons respectively connected by oppositely extending connecting rods with longitudinally aligned crank portions of said central crankshafts and said first and second end crankshafts respectively, the connection of the connecting rods between the opposed pistons and crank portions being such that the opposed first pistons in said first pair of cylinders move together toward and away from one another between inner and outer limiting positions through successive cycles including simultaneous compression strokes followed by simultaneous power drive strokes and the opposed second pistons in said second pair of cylinders move together toward and away from one another between inner and outer limiting positions through successive cycles including simultaneous compression strokes followed by simultaneous power drive stoke 180° out of phase with respect to the corresponding strokes of said opposed first pistons;

each pair of cylinders having inlet and outlet openings therein positioned in spaced relation so as to communicate with respect to one another within the associated cylinder when the associated pistons are in said outer limiting position thereof enabling a compression stoke movement of said pistons out of said outer limiting position to close said openings and trap air in the cylinder between the pistons and to compress air into a combustion chamber within the associated cylinder as the pistons reach the inner limiting position;

a fuel injector for each cylinder positioned and controllable to inject fuel into the combustion chamber of an associated cylinder, the combustion chambers of each pair of cylinders being communicated with one another by a passage extending through a hub of a gear of said gear train in said space; and a controller for said injectors operable near the end of simultaneous compression strokes of the opposed first and second pistons in their respective cylinders to selectively control the injectors for each pair of cylinders to (1) undergo an injection of fuel into compressed air at an auto ignition pressure and temperature in the combustion chamber of each pair of cylinders so that the injection creates ignition of the fuel causing increased pressure conditions in the associated cylinders resulting in simultaneous internally fired power drive strokes of the associated opposed pistons in each pair of cylinders or (2) one of the injectors of each pair of cylinders are controlled to undergo injection into the associate cylinders resulting in the opposed pistons therein to simultaneous internally fired power drive strokes therein and another of the injectors of the each pair of cylinders is controlled to undergo a skipped injection wherein no fuel is injected so that the associated cylinder can share by means of said passage the increased pressure conditions of the first mentioned, internally fired power stroke result in the opposed pistons of the associated pair of cylinders to under a shared power drive stroke therewith.

2. An internal combustion engine as defined in claim 1 wherein said controller is a computer programmed to control said injectors so that the engine operates in a selected one of the following modes: (1) an emergency power mode wherein said opposed first and second pistons undergo simultaneous internally fired power drive strokes in their respective cylinders during each cycle (2) a normal power mode where one of the opposed first or second pistons undergo simultaneous internally fired power drive strokes in their respective cylinders during each cycle while the other of the opposed first or second pistons undergo simultaneous internally fired and shared power drive strokes in their respective cylinders during each cycle and (3) a coasting mode wherein the opposed first and second pistons undergo simultaneous internally fired and shared power drive strokes in their respective cylinders during each cycle.

3. An internal combustion engine as defined in claim 2 wherein said computer is programmed to receive three different mode selecting input signals which select one of three output signals for modes (1), (2) or (3).

4. An internal combustion engine as defined in claim 3 wherein said three different mode selecting input signals are created by manually pressing one button of a three button electrical unit connected to said computer.

5. An internal combustion engine as defined in claim 3 wherein said three different mode selecting input signals are created by vehicle sensors.

6. An internal combustion engine as defined in claim 5 wherein the vehicle sensor for creating the mode selecting input signal for selecting mode (1) is a switch actuated when a vehicle accelerator pedal is pressed to a floor board.

7. An internal combustion engine as defined 2 wherein the first or second opposed pistons undergoing simultaneous internally fired and shared power drive strokes in modes (2) and (3) are alternated between the opposed first or second pistons during each predetermined number of cycles.

8. An internal combustion engine as defined in claim 7 wherein said predetermined number of cycles is between 1 and 10.

* * * * *